US005966976A

United States Patent [19]

Haraga

[11] Patent Number: 5,966,976

[45] Date of Patent: Oct. 19, 1999

[54] COMPRESSION WORKING METHOD AND COMPRESSION WORKING APPARATUS

[75] Inventor: Yoshio Haraga, Sagamihara, Japan

[73] Assignee: Amada Metrecs Company, Limited, Kanagawa-ken, Japan

[21] Appl. No.: 09/064,880

[22] Filed: Apr. 23, 1998

[30] Foreign Application Priority Data

Nov. 19, 1997 [JP] Japan ..... 9-317869
Feb. 6, 1998 [JP] Japan ..... 10-025274

[51] Int. Cl.[6] ..... B21D 22/10

[52] U.S. Cl. ..... 72/57; 72/60

[58] Field of Search ..... 72/469, 54, 57, 72/58, 56, 60

[56] References Cited

U.S. PATENT DOCUMENTS

| | | | |
|---|---|---|---|
| 2,606,516 | 8/1952 | Raynes . | |
| 2,927,549 | 3/1960 | Derbyshire | 72/54 |
| 3,382,690 | 5/1968 | Achler et al. | 72/57 |
| 3,757,718 | 9/1973 | Johnson | 72/57 |
| 5,205,146 | 4/1993 | Wilkins et al. | 72/57 |
| 5,599,565 | 2/1997 | Dittlo . | |

FOREIGN PATENT DOCUMENTS

| | | | |
|---|---|---|---|
| 193693 | 12/1957 | Germany | 72/57 |
| 1752706 | 5/1971 | Germany . | |
| 867470 | 9/1981 | U.S.S.R. | 72/57 |
| 1202665 | 1/1986 | U.S.S.R. | 72/57 |
| 1 248 553 | 10/1971 | United Kingdom . | |

*Primary Examiner*—David Jones
*Attorney, Agent, or Firm*—Whitham, Curtis & Whitham

[57] ABSTRACT

A compress working method and a compress working apparatus are provided for readily performing drawing in an arbitrary shape at a low cost and in a short time without using an expensive mold in the manufacturing of small batch products. A metal plate, which is a workpiece, is placed on a laminate die formed with a recess in a desired shape, and a holder is set on the metal plate. An elastic punch accommodated in the holder is urged to press the holder onto the metal plate with a portion of the urging force. In this state, a portion of the elastic punch is intruded into the recess of the laminate die together with the metal plate. The elastic punch is then unloaded after the metal plate is formed with a draw conformal to the recess of the laminate die. Since the elastic punch serves as an upper die in the press working, it is possible to readily perform the drawing in an arbitrary shape at a low cost and in a short time without using an expensive mold in the manufacturing of small batch products.

9 Claims, 7 Drawing Sheets

COMPRESSION WORKING METHOD AND COMPRESSION WORKING APPARATUS

BACKGROUND OF THE INVENTION

1. Field of the Invention

The present invention relates generally to a compress working method, and more particularly to a compress working method which can perform drawing on a metal plate in an arbitrary shape, utilizing an elastically deformable elastic punch. The present invention is also directed to a compress working apparatus for implementing the above-mentioned method.

2. Description of the Related Art

In the sheet metal industry, a CNC (numerical control) punch press, a CNC press brake and a CNC laser profilling are currently utilized mainly for shearing, punching and bending as basic techniques. When drawing is added to the above-mentioned working, such working falls within the press working, so that the current sheet metal cannot address to it. As an alternative, there is only a method of assembling sheet metal parts into a product by welding.

In recent years, in the press working and sheet metal industries, a wide variety of products are required in a small amount with a relatively short period to an appointed time limit of delivery, for example, such as proto-type or the like. However, with the press machining which involves the fabrication of a mold in a severe environment in terms of cost, it takes an excessive time before starting the manufacturing of a product. In addition, a cost for a mold is high relative to a total number of lots of products, so that such press machining strategy is not feasible in terms of cost.

Also, techniques using weld or the like would cause a degraded quality of products, while a technique involving surface treatment such as plating, coating or the like would introduce a further increase in cost.

OBJECTS AND SUMMARY OF THE INVENTION

The present invention has been made in view of the problems mentioned above, and it is an object of the present invention to provide a compress working method and a compress working apparatus which are capable of readily performing the drawing in an arbitrary shape at a low cost and in a short time without using an expensive mold in a small batch production.

To achieve the above-object, the present invention provides a compress working method for working a metal plate comprising the steps of: providing a die formed with a recess in a desired shape; placing a metal plate on the die; setting a holder on the metal plate, urging an elastic punch accommodated in the holder to urge the holder onto the metal plate with a portion of the urging force applied to the holder; intruding a portion of the elastic punch into the recess of the die together with the metal plate; and unloading the elastic punch after forming the metal plate with a draw conformal to the recess in the metal plate.

The present invention also provides a compress working apparatus comprising: a die formed with a recess in a desired shape; a holder placed on an upper surface of the die with a metal plate interposed therebetween; an elastic punch accommodated in the holder; and urging means for urging the elastic punch.

In the compress working apparatus, the elastic punch may be made of urethane or rubber. Also, the elastic punch may be formed with tapered surfaces around upper and lower peripheral edges, wherein the tapered surface formed around the upper peripheral edge may taper off in an upward direction, and the tapered surface formed around the lower peripheral edge may taper off in a downward direction.

Also, the holder may be formed with a two-step hole having a first portion with a larger diameter and a second portion with a smaller diameter, and a joining portion of the first and second portions is formed with a tapered surface which tapers off in a downward direction. The holder may also be composed of a plurality of parts, the parts being integrated into the holder.

Further, the holder may be composed of a plurality of parts, wherein the parts includes a blank holder portion having the tapered surface, and the blank holder portion is removably attached to the remaining parts of the holder.

The holder may comprise one of at least three blank holder portions with tapered surfaces having different inclination angles, the three blank holder portions including a blank holder portion for a higher pressure range having an inclination angle set at 0°, a blank holder portion for a middle pressure range having an inclination angle ranging from 3° to 45°, and a blank holder portion for lower pressure range having an inclination angle ranging from 45° to 89°.

Thus, according to the compress working method using the compress working apparatus of the present invention, a metal plate, which is a workpiece, is interposed between the die and the elastic punch, and the elastic punch is urged to elastically deform the metal plate. A portion of the elastic punch is intruded into the recess of the die together with the metal plate to form the metal plate with a draw conformal to the shape of the recess of the die. Thus, the elastic punch serves as an upper die in the press working. It is therefore possible to readily perform the drawing in an arbitrary shape at a low cost and in a short time without using an expensive mold, typically employed in the press working, in the manufacturing of small batch products.

Also, since the holder is formed with a tapered surface having a predetermined inclination angle, the holder urges the metal plate with a vertical component of the urging force from the elastic punch on the tapered surface, and the holder also serves as a blank holder. Therefore, a dedicated blank holder can be eliminated, resulting in a simplified structure of the compress working apparatus and accordingly a reduced cost.

Further, since the holder is divided into parts such that the blank holder portion is removable, an urging force to the metal plate can be adjusted to a value suitable to the thickness and material of the metal plate by exchanging only the blank holder portion rather than exchanging the entire holder. In addition, since the slidable holder portion and the holder body can be commonly used with different blank holder portions, a reduction in cost is achieved.

The above and other objects, advantages and features of the present invention will become more apparent with reference to the following detailed description of preferred embodiments when read in conjunction with the accompanying drawings.

DESCRIPTION OF THE PREFERRED EMBODIMENTS

The present invention will hereinafter be described in connection with several embodiments thereof with reference to the accompanying drawings.

Figure 5:
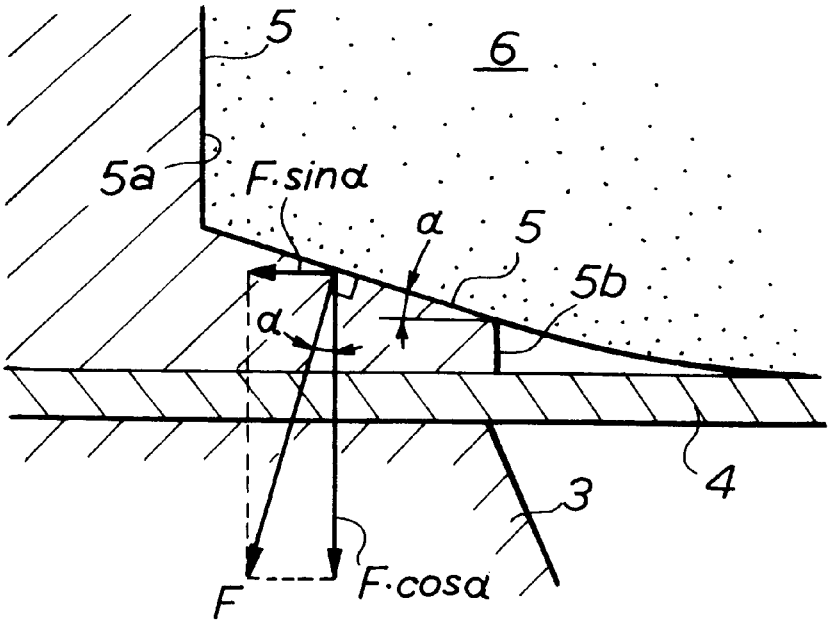
FIG. 5 is an enlarged view illustrating in detail a portion A in FIG. 2.
Figure 6:
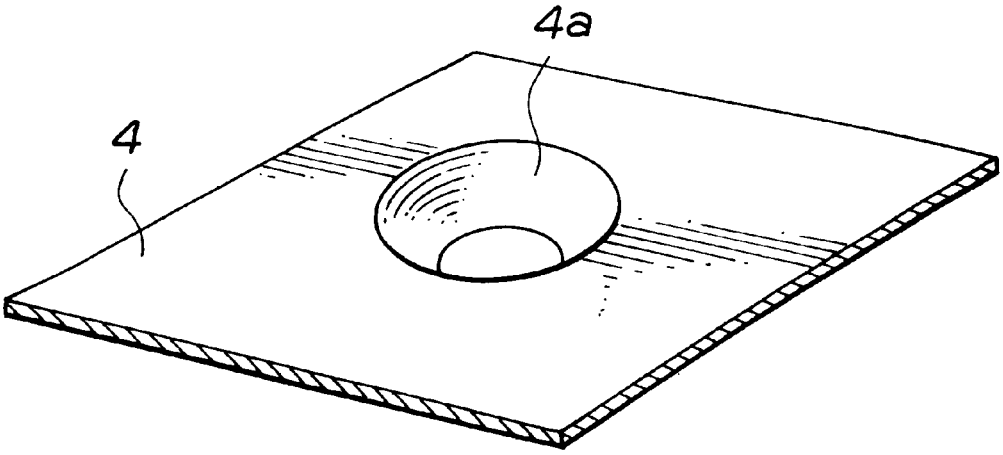
FIGS. 6–9 are partial perspective views each illustrating an example of a product worked by the compress working method of the first embodiment.

FIGS. 1–4 are cross-sectional views illustrating various steps of a compress working method according to a first embodiment of the present invention in order. FIG. 5 is an enlarged view illustrating in detail a portion A in FIG. 2. FIG. 6 is a partial perspective view of a product worked by the compress working method according to the first embodiment of the present invention.

Figure 1:
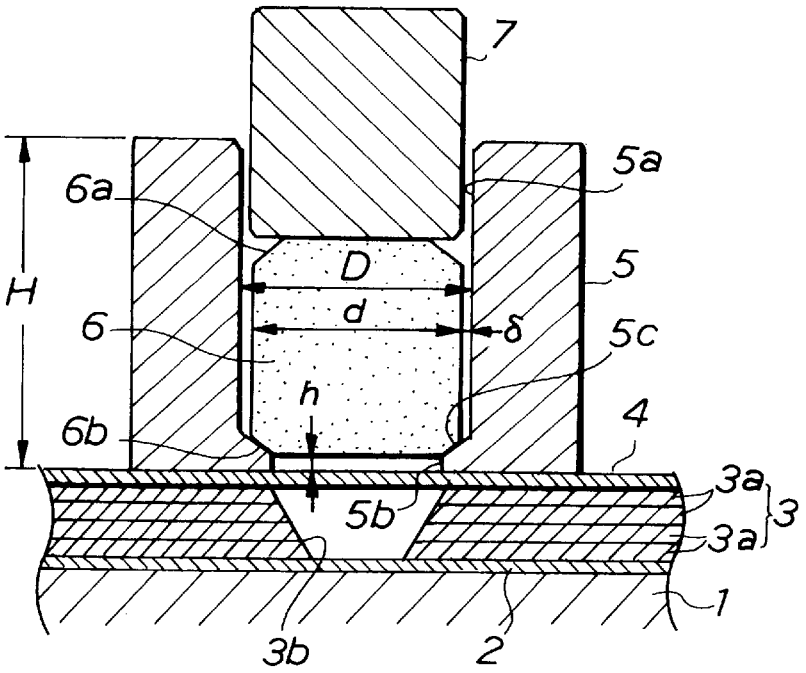
FIGS. 1–4 are cross-sectional views illustrating various steps of a compress working method using a compress working apparatus according to a first embodiment of the present invention.

Referring first to FIG. 1, a basic configuration of a compress working apparatus according to the present invention will be described below.

In FIG. 1, a press platen bolster (machining center) 1 has two metal plates 2 set thereon, and a laminate die 3 is carried on the metal plates 2 and set in place thereon. The laminate die 3 is formed of a plurality of layers of metal plates 3*a* (in the illustrated example, four layers), and is formed therethrough with a recess 3*b* of a desired shape (an inverse conical shape in this embodiment).

On the laminate die 3, a metal plate 4, which is a so-called workpiece (material to be worked), is set, and a substantially cylindrical holder 5 is further set on the metal plate 4. The holder 5 is formed with two continuous holes 5*a*, 5*b* having different diameters extending through a central portion thereof, wherein the height h of the smaller circular hole 5*b*, open on the bottom surface of the holder 5, is set sufficiently smaller than the entire height H of the holder 5 (in this embodiment, h=2 mm).

A joining portion between the larger and smaller circular holes 5*a*, 5*b* is formed with a tapered surface 5*c* which tapers off in the downward direction. As illustrated in detail in FIG. 5, the tapered surface 5*a* has an inclination angle $\alpha$ ranging from 3° to 45° (in this embodiment, $\alpha$=12°).

In the setting state illustrated in FIG. 1, the holder 5 is positioned with the smaller circular hole 5*b*, open on the bottom surface thereof, faces the recess 3*b* of the laminate die 3, and an elastic punch 6 made of an elastic material such as rubber and molded substantially in a cylindrical shape is fitted in the larger circular hole 5*a* of the holder 5. A cylindrical slidable punch 7, movable within the larger circular hole 5*a* in the vertical direction, abuts to the upper surface of the elastic punch 6.

In the setting state illustrated in FIG. 1, the elastic punch 6 has its outer diameter d smaller than the inner diameter D of the circular hole 5*a* of the holder 5 (d<D), so that an annular predetermined spacing $\delta$ is formed therebetween. The elastic punch 6 has tapered surfaces 6*a*, 6*b* around the upper and lower peripheral edges, the diameters of which are gradually reduced toward upward and downward directions, respectively. The slidable punch 7 is driven by a hydraulic press mechanism to move vertically within the holder 5, and is loaded with a predetermined press load.

The compress working apparatus according to the present invention is implemented by an urging means including the abovementioned bolster 1, metal plate 2, laminate die 3, holder 5, elastic punch 6, slidable punch 7 and hydraulic press mechanism, not shown. In the following, the compress working performed by this compress working apparatus will be described with reference to FIGS. 1–6.

Figure 2:
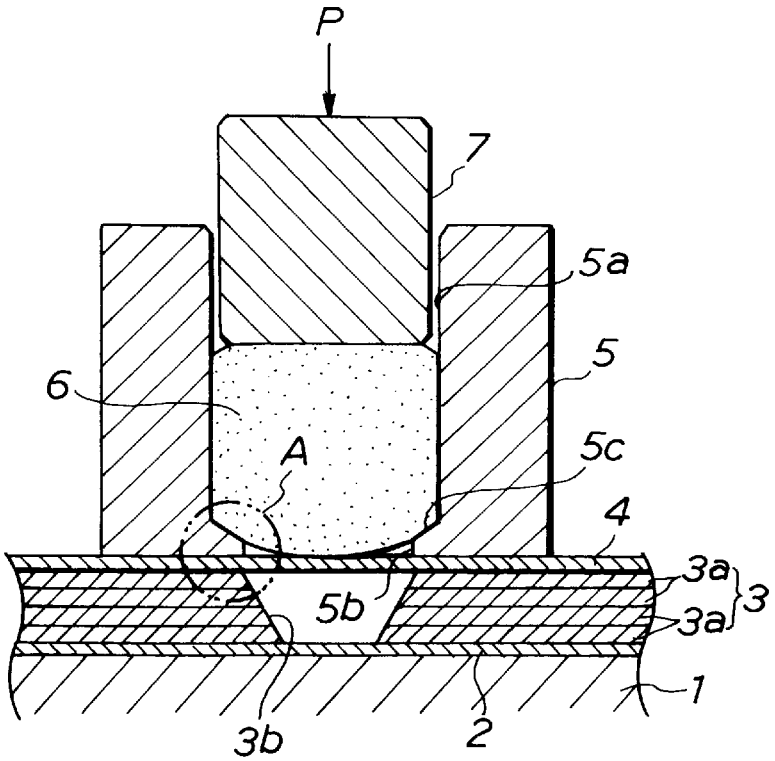

In the setting state illustrated in FIG. 1, when the slidable punch 7 is applied with a predetermined press load P by driving a hydraulic press mechanism, not shown, the elastic punch 6 fitted in the holder 5 is urged by the slidable punch 7 to exhibit an elastic deformation, as illustrated in FIG. 2, whereby the elastic punch 6 expands so that its outer peripheral surface comes in close contact with the inner wall of the circular hole 5*a* of the holder 5, and the tapered surface 6*b* formed along the lower peripheral edge smoothly penetrates into the smaller circular hole 5*b* along the tapered surface 5*c* of the holder 5, and a lower portion of the elastic punch 6 is extruded into the circular hole 5*b* of the holder 5 and abuts to the upper surface of the metal plate 4, which is a workpiece, as illustrated. In this event, since the holder 5 is formed with the tapered surface 5*c* having the predetermined inclination angle $\alpha$, an urging force F acts on the tapered surface 5*c* from the elastic punch 6, as illustrated in FIG. 5, so that the holder 5 urges the metal plate 4 with a vertical component of the urging force F, i.e., F·cos $\alpha$. As a result, the holder 5 also serves as blank holder.

By changing the inclination angle $\alpha$ of the tapered surface formed around the upper peripheral edge of the elastic punch 6 to provide the upper surface of the elastic punch 6 with a different area (pressure receiving area), it is possible to adjust a pressure applied onto the upper surface of the elastic punch 6 at an initial stage of the working. For example, the inclination angle a of the tapered surface may be increased to reduce the area of the upper surface (pressure receiving area) of the elastic punch 6 for increasing the surface pressure.

Figure 3:
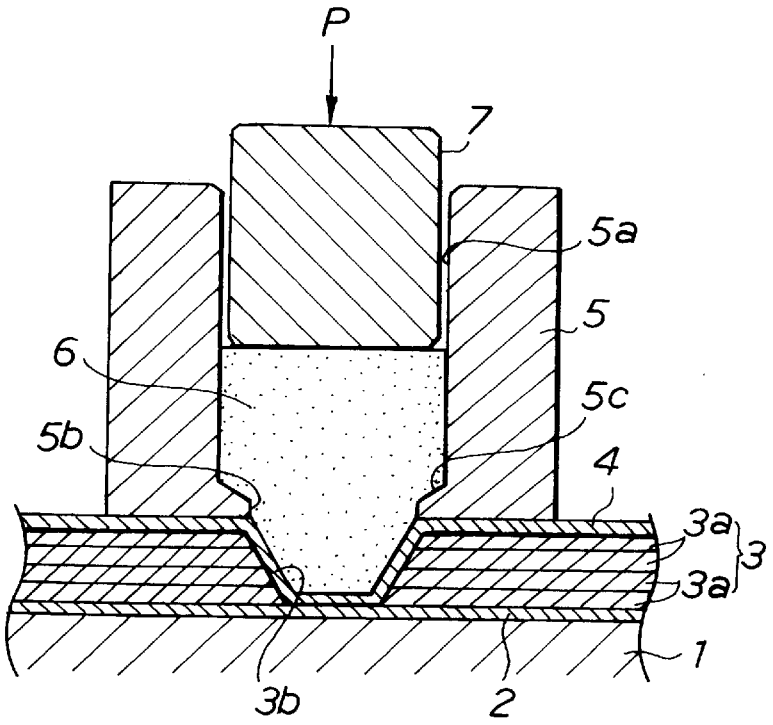

When the elastic punch 6 is continuously applied with the press load P, the elastic punch 6 exhibits further elastic deformation, as illustrated in FIG. 3, so that a portion of the elastic punch 6 is intruded, together with the metal plate 4, into the recess 3*b* of the laminate die 3. In this way, the elastic punch 6 functions as an upper die (rigid body) having a protrusion Id conformal to the recess 3*b* of the laminate die 3, and causes a plastic deformation to a portion of the metal plate 4 conformal to the shape of the recess 3*b* of the laminate die 3 to draw the same. Again in this event, since the tapered surface 5*c* of the holder 5 is applied with the urging force F (see FIG. 5) from the elastic punch 6, the holder serves as a blank holder, as described above, to prevent the metal plate 4 from wrinkling.

Figure 4:
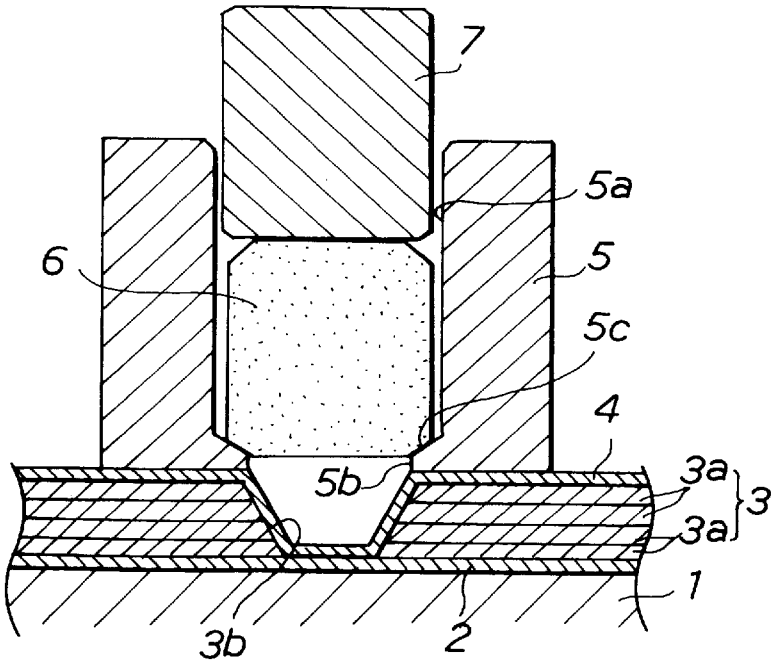

After the metal plate 4 is provided with a desired shape by the drawing in the manner described above, as the press load P is unloaded from the elastic punch 6, the elastic punch 6 made of an elastic material returns to the original state (the setting state illustrated in FIG. 1) as illustrated in FIG. 4. Similar steps may be repeated subsequently to form the metal plate 4 with a recess 4*a* as illustrated in FIG. 6 by the drawing. Generally, in the compress working method according to the first embodiment, the metal plate 4 will not suffer from scratches or the like. However, it is further ensured that the metal plate 4 can be prevented from possible damage due to the urging force of the holder 5 by interposing a film, a tape or the like between the metal plate 4 and the holder 5.

Figure 7:
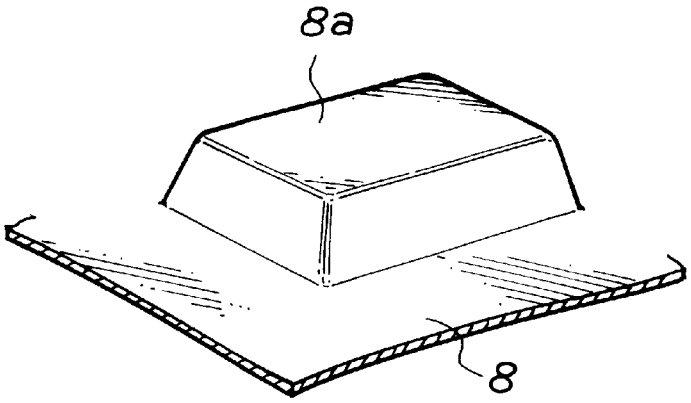
Figure 8:
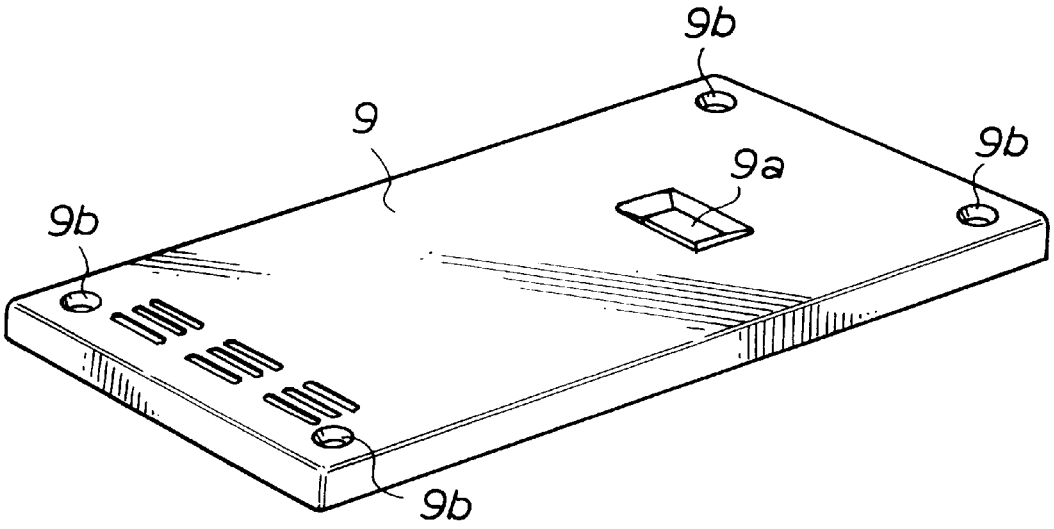
Figure 9:
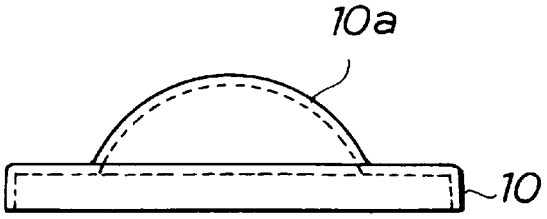

According to the first embodiment as described above, the metal plate 4, which is a workpiece, is interposed between the laminate die 3 and the elastic punch 6 which is applied with a pressure to cause elastic deformation, and a portion of the elastic punch 6 is intruded into the recess 3*b* of the laminate die 3 together with the metal plate 4 to provide the metal plate 4 with the draw conformal to the shape of the recess 3*b* of the laminate die 3, so that the elastic punch 6 serves as an upper die in the press work. It is therefore possible to readily provide the draw in an arbitrary shape at a low cost and in a short time without using an expensive die typically required in the press work, in the manufacturing of small batch products. For example, a metal plate 8 can be formed with a rectangular protrusion 8*a* as illustrated in FIG. 7; a metal plate 9 can be formed with a rectangular recess 9*a* and screw seats 9*b* as illustrated in FIG. 8; and a metal plate 10 can be formed even with a hemispherical protrusion 10*a* as illustrated in FIG. 9.

In this embodiment, since the holder 5 is formed with the tapered surface 5*c* having the predetermined angle α, the vertical component of the urging force F acting on this tapered surface 5*c* from the elastic punch 6 causes the holder 5 to urge the metal plate 4 so that the holder 5 serves as a blank holder. Therefore, a dedicated blank holder can be eliminated, resulting in a simplified structure of the compress working apparatus and accordingly a reduced cost.

Next, a compress working apparatus according to a second embodiment will be described with reference to FIG. 10.

Figure 10:
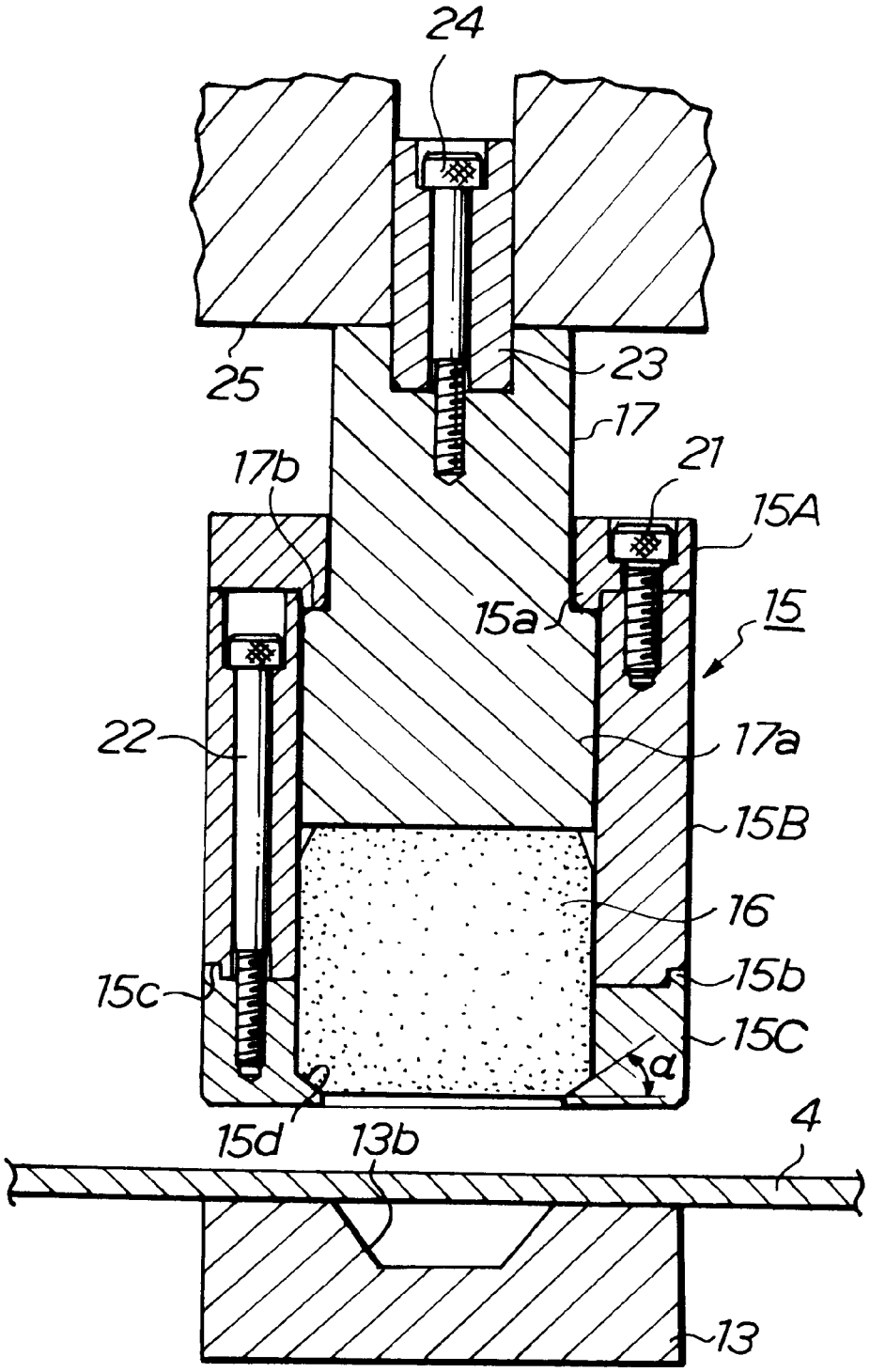
FIG. 10 is a cross-sectional view illustrating a compress working apparatus according to a second embodiment of the present invention.

FIG. 10 is a cross-sectional view illustrating the compress working apparatus according to the second embodiment. The compress working apparatus comprises a lower die 13, a substantially cylindrical holder 15 positioned above the lower die 13, a cylindrical elastic punch 16 and a slidable punch 17. The lower die 13 is formed in the upper surface thereof with a recess 13*b* in a desired shape (an inverse conical shape in this embodiment).

The holder 15 is divided into a slidable holder portion 15A, a holder body 15B and a blank holder portion 15C. The slidable holder portion 15A is removably arranged on the holder body 15B, while the blank holder portion 15C is removably arranged beneath the holder body 15B, whereby the three portions are assembled into the holder 15.

More specifically, the slidable holder portion 15A, formed in an annular shape, is positioned on the holder body 15B with a protrusion 15A extending from the lower inner periphery thereof being fitted into the upper inner periphery of the holder body 15B. In this state, the slidable holder portion 15A is secured on the holder body 15B with a plurality of bolts 21 (only one bolt is shown in FIG. 10). The blank holder portion 15C, in turn, is positioned beneath the holder body 15B with an annular protrusion 15*b* extending from the upper outer periphery thereof being fitted into an annular recess 15*c* formed around the lower outer periphery of the holder body 15B. Then, the blank holder portion 15C is secured beneath the holder body 15B with a plurality of bolts 22 (only one bolt is shown in FIG. 10).

The blank holder portion 15C of the holder 15 is formed with a tapered surface 15*d* which tapers off in the downward direction.

The elastic punch 16 is made of an elastic material such as urethane, rubber or the like, in a manner similar to the first embodiment, and the slidable punch 17 is formed in a two-step cylindrical shape consisting of an upper portion having a smaller diameter and a lower portion 17*a* having a larger diameter. The bottom surface of the slidable punch 17 abuts to the upper surface of the elastic punch 16, and a step 17*b* abuts to the slidable holder portion 15A of the holder 15. Therefore, the slidable punch 17, the holder 15 and the elastic punch 16 integrally move in the vertical direction.

The slidable punch 17 has its upper end attached to a press machine 25 with a shank 23 and a bolt 24, as illustrated in FIG. 10. With a metal plate 4, which is a workpiece, placed on the die 13 as illustrated, the press machine 25 is driven to move the assembly of the slidable punch 17, the holder 15 and the elastic punch 16 downwardly, causing the bottom surface of the holder 15 (the blank holder portion 15C) to abut to the metal plate 4 and stop moving down. Subsequently, as the slidable punch 17 is further moved downwardly, the elastic punch 16 is urged by the slidable punch 17 to exhibit elastic deformation (compress deformation). Similarly to the first embodiment, the elastic punch 16 serves as an upper die (rigid body) having a protrusion conformal to the recess 13*b* of the lower die 13, and therefore plastically deforms a portion of the metal plate 4 conformally to the shape of the recess 13*b* formed in the lower die 13 to perform drawing, whereby the metal plate 4 is formed with a recess 4*a* as illustrated in FIG. 6.

In the foregoing compress working step, the blank holder portion 15C of the holder 15 is applied with a vertical component F ·cos α (see FIG. 5) of a force F from the elastic punch 16 acting on the tapered surface 15*d* to urge the metal plate 4, so that the metal plate 4 is prevented from wrinkling.

It should be noted that a force (urging force) with which the blank holder 15C of the holder 15 urges the metal plate 4 varies depending on a varying thickness and material of the metal plate 4, and that the urging force may be adjusted by changing the inclination angle a of the tapered surface 15*d* of the blank holder portion 15C. More specifically, the urging force F·cos α can be increased as the inclination angle α is set smaller.

Figure 11A:
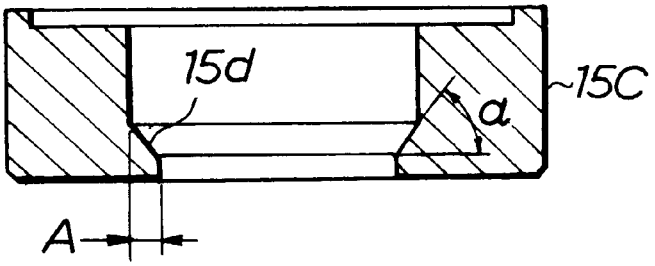
FIGS. 11(*a*)–11(*c*) are cross-sectional views illustrating various forms of a blank holder portion of a holder.
Figure 11B:
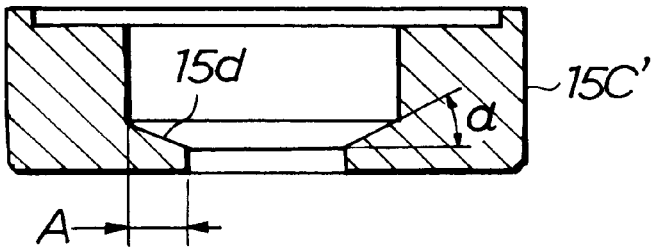
Figure 11C:
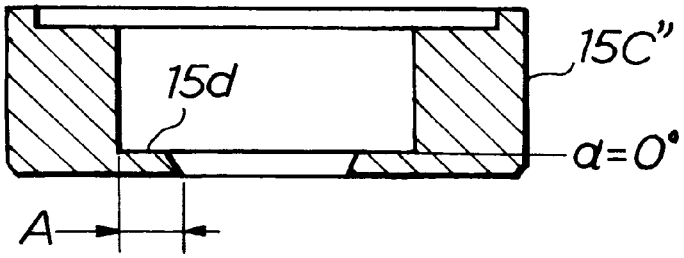

In the second embodiment, since the holder 15 is divided into three components such that the blank holder portion 15C is removably mounted to the holder body 15B, the blank holder portion 15C can be readily exchanged. For example, three kinds of blank holder portions 15C, 15C', 15C" having different inclination angles a from each other, as illustrated in FIGS. 11(*a*)–11(*c*), may be provided such that an optimal one is selectively mounted to the holder body 15B in accordance with the thickness and material of a particular metal plate 4. Here, FIG. 11(*a*) illustrates the blank holder portion 15C for a lower pressure range with an inclination angle α of the tapered surface 15*d* ranging from 45° to 89°; FIG. 11(*b*) illustrates the blank holder portion 15C' for a middle pressure range with an inclination angle a of the tapered surface 15*d* ranging from 0° to 45°; and FIG. 11(*c*) illustrates the blank holder portion 15C" for a higher pressure range with an inclination angle α of the tapered surface 15*d* set at 0°, respectively. It should be noted that, instead of the inclination angle α of the tapered surface 15*d*, a width dimension A may be changed to adjust the urging force to the metal plate 4.

According to the compress working apparatus of the second embodiment as described above, since the holder 15 is divided into three components such that the blank holder portion 15C is removably mounted to the holder body B, an urging force to the metal plate 4 can be adjusted to a value suitable to the thickness and material of the metal plate 4 by exchanging only the blank holder portion 15C rather than exchanging the entire holder 15. In addition, since the slidable holder portion 15A and the holder body 15B can be commonly used with different blank holder portions 15C, a reduction in cost is achieved.

It goes without saying that the second embodiment can produce similar effects to those of the first embodiment.

Figure 12:
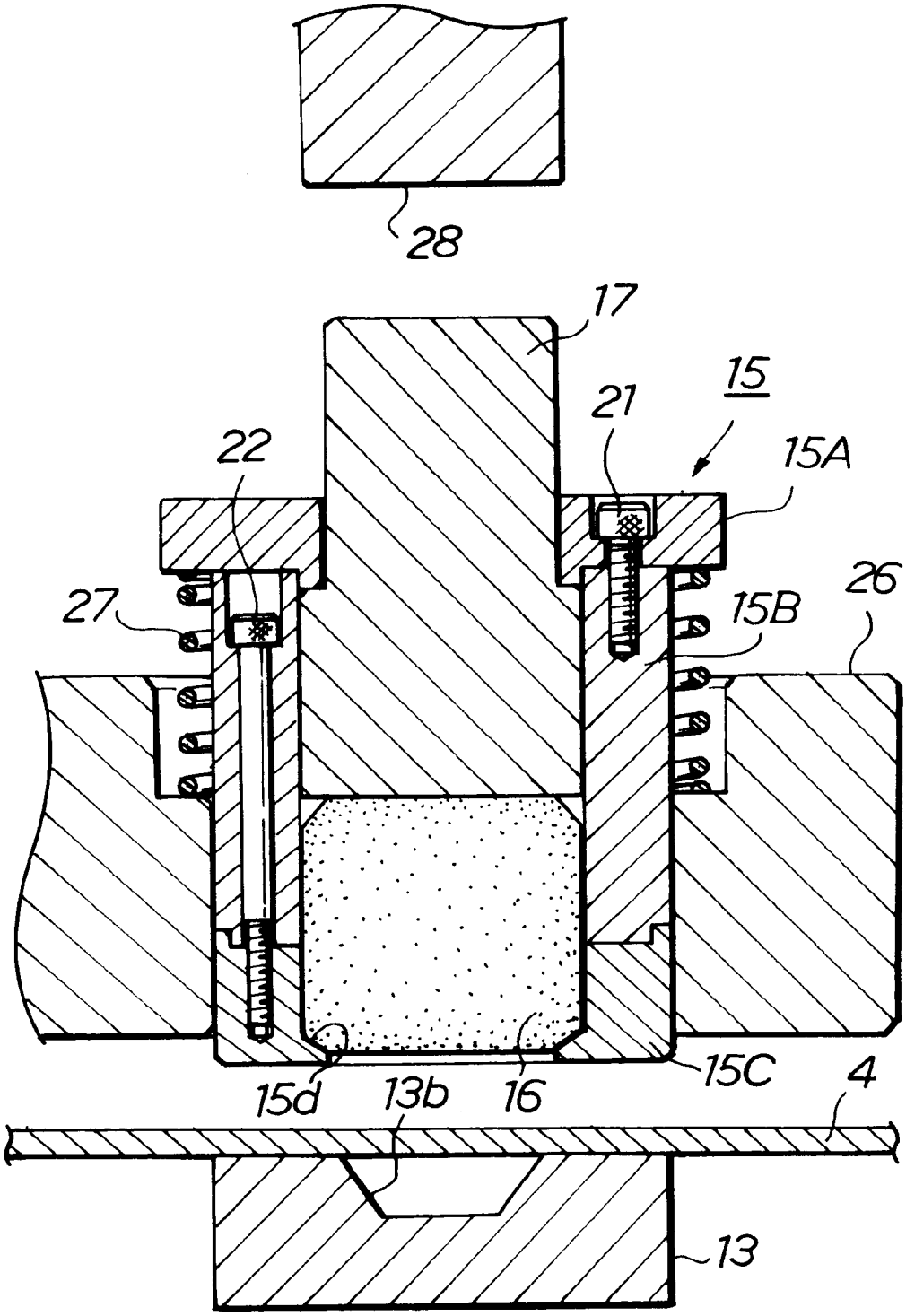
FIG. 12 is a cross-sectional view illustrating a compress working apparatus according to a third embodiment of the present invention.

Next, a compress working apparatus according to a third embodiment of the present invention will be described with reference to FIG. 12. FIG. 12 is a cross-sectional view illustrating the compress working apparatus according to the third embodiment, in which identical elements to those previously illustrated in FIG. 10 are designated the same reference numerals, and explanation thereon is omitted.

The third embodiment shows an example of automated compress working implemented by mounting the compress working apparatus to a CNC turret punch press. The structure of the compress working apparatus is basically identical to that of the second embodiment.

In the third embodiment, a holder 15 having an elastic punch 16 and a slider punch 17 accommodated therein is vertically removably held by an arm 26 of the CNC turret punch press. The outer periphery of a slidable holder portion 15A of the holder 15 is extended toward the outside of a holder body 15B to form a flange. A coil spring 27 is interposed between the flange and the arm 26 in a compressed state to urge the holder 15, the elastic punch 16 and the slidable punch 17 upwardly.

As the slidable punch 17 is urged by a punch 28 of the CNC turret punch press with a metal plate 4, which is a work, carried on a die 13 as illustrated, the slidable punch 17 is moved downwardly together with the holder 15 and the elastic punch 16 along the arm 26, causing the bottom surface of the holder 15 (blank holder portion 15C) to abut to the metal plate 4 and stop moving downwardly. In this event, the coil spring 27 is compress-deformed to have a higher resilient force.

Subsequently, as the slidable punch 17 is further urged to move downwardly, the elastic punch 16 is urged by the slidable punch 17 to exhibit elastic deformation (compress deformation), so that the elastic punch 16 serves as an upper die (rigid body) having a protrusion conformal to the shape of a recess 13*b* of the die 13, in a manner similar to the first embodiment, to plastically deform a portion of the metal plate 4 conformally to the shape of the recess 13*b* of the die 13, whereby the metal plate 4 is formed with a recess 4*a* as illustrated in FIG. 6.

Then, after the metal plate 4 has undergone the drawing in a desired shape, the punch 28 of the CNC turret punch press is moved upwardly to unload the compress working apparatus, causing the holder 15, the elastic punch 16 and the slidable punch 17 to move upwardly with a snapping force of the coil spring 27 to return to the setting state illustrated in FIG. 12. Subsequently, the drawing can be automatically performed on the metal plate 4 in a similar manner.

Thus, the third embodiment is advantageous in that compress working can be automatically performed in a highly efficient manner, in addition to producing similar effects to those of the foregoing first and second embodiments.

As is apparent from the foregoing description, according to the present invention, a metal plate, which is a workpiece, is placed on a die formed with a recess in a desired shape, and a holder is set on the metal plate. An elastic punch accommodated in the holder is urged to press the holder onto the metal plate with a portion of the urging force. In this state, a portion of the elastic punch is intruded into the recess of the laminate die together with the metal plate. The elastic punch is then unloaded after the metal plate is formed with a draw conformal to the recess of the laminate die. It is therefore possible to readily perform the drawing in an arbitrary shape at a low cost and in a short time without using an expensive mold, typically employed in the press working, in the manufacturing of small batch products.

Further, since the holder is divided into parts such that the blank holder portion is removable, an urging force to the metal plate can be adjusted to a value suitable to the thickness and material of the metal plate by exchanging only the blank holder portion rather than exchanging the entire holder. In addition, since the slidable holder portion and the holder body can be commonly used with different blank holder portions, a reduction in cost is advantageously achieved.

Although the present invention has been described with reference to specific embodiments, numerous modifications and variations can be made by those skilled in the art without departing from the spirit and scope of the invention.

What is claimed is:

1. A compress working method for working a metal plate comprising the steps of:

providing a die formed with a recess in a desired shape;

placing a metal plate on said die;

setting a holder, said holder including a two-step hole having a first portion with a larger diameter and a second portion with a smaller diameter and a joining portion of said first and second portions formed to extend between said larger diameter and said smaller diameter, wherein said holder includes a blank holder portion and having said joining portion, and wherein said holder comprises one of at least three blank holder portions with surfaces having different inclination angles, said blank holder portioned including a blank holder portion for a higher pressure range having an inclination angle set at 0, a blank holder portion for a middle pressure range having an inclination angle ranging from 3 to 45 and a blank holder portion for lower pressure range having an inclination angle ranging from 45 to 89, on said metal plate, urging an elastic punch accommodated in said holder onto said metal plate with a portion of the urging force applied to said holder;

intruding a portion of said elastic punch into said recess of said die together with said metal plate; and unloading said elastic punch after forming said metal plate with a draw conformal to said recess in said metal plate.

2. A compress working apparatus comprising:

a die formed with a recess in a desired shape;

a holder placed on an upper surface of said die with a metal plate interposed therebetween;

an elastic punch accommodated in said holder; and urging means for urging said elastic punch;

wherein said holder includes a two-step hole having a first portion with a larger diameter and a second portion with a smaller diameter and a joining portion of said first and second portions formed to extend between said larger diameter and said smaller diameter, wherein said parts include a blank holder portion and having said joining portion, and wherein said holder comprises one of at least three blank holder portions with surfaces having different inclination angles, said blank holder portions including a blank holder portion for a higher pressure range having an inclination angle set at 0, a blank holder portion for a middle pressure range having an inclination angle ranging from 3 to 45 and a blank holder portion for lower pressure range having an inclination angle ranging from 45 to 89.

3. A compress working apparatus according to claim 2, wherein said elastic punch is made of urethane or rubber.

4. A compress working apparatus according to claim 3, wherein said elastic punch is formed with tapered surfaces around upper and lower peripheral edges, said tapered surface formed around the upper peripheral edge tapering off in an upward direction, and said tapered surface formed around the lower peripheral edge tapering off in a downward direction.

5. A compress working apparatus according to claim 3, wherein said holder is composed of a plurality of parts, said parts being integrated into said holder.

6. A compress working apparatus according to claim 3, wherein said holder is composed of a plurality of parts, said parts including a blank holder portion having said joining portion, said blank holder portion being removably attached to the remaining parts of said holder.

7. A compress working apparatus according to claim 2, wherein said elastic punch is formed with tapered surfaces around upper and lower peripheral edges, said tapered surface formed around the upper peripheral edge tapering off in an upward direction, and said tapered surface formed around the lower peripheral edge tapering off in a downward direction.

8. A compress working apparatus according to claim 2, wherein said holder is composed of a plurality of parts, said parts being integrated into said holder.

9. A compress working apparatus according to claim 2, wherein said holder is composed of a plurality of parts, said parts including a blank holder portion having said joining portion, said blank holder portion being removably attached to the remaining parts of said holder.

* * * * *